US005223362A

United States Patent [19]

Kobata et al.

[11] Patent Number: 5,223,362

[45] Date of Patent: * Jun. 29, 1993

[54] LAMINATED ORGANIC PHOTOSENSITIVE MATERIAL

[75] Inventors: Tomokazu Kobata; Yosuke Matsui, both of Kobe, Japan

[73] Assignee: Bando Chemical Industries, Ltd., Kobe, Japan

[ * ] Notice: The portion of the term of this patent subsequent to Dec. 26, 2006 has been disclaimed.

[21] Appl. No.: 553,814

[22] Filed: Jul. 19, 1990

[30] Foreign Application Priority Data

Jul. 19, 1989 [JP] Japan ..... 1-187650

[51] Int. Cl.[5] ..... G03G 5/14

[52] U.S. Cl. ..... 430/59; 430/73

[58] Field of Search ..... 430/59, 73, 74

[56] References Cited

U.S. PATENT DOCUMENTS 4,865,934 9/1989 Ueda et al. ..... 430/59

4,886,719 12/1989 Tanaka et al. ..... 430/66

4,889,785 12/1989 Kobata et al. ..... 430/59

*Primary Examiner*—John Goodrow

*Attorney, Agent, or Firm*—Wegner, Cantor, Mueller & Player

[57] ABSTRACT

A laminated organic photosensitive material which comprises an electroconductive support, a charge producing layer and a charge transporting layer formed thereon wherein the charge producing layer contains X-type nonmetal phthalocyanine as a charge producing substance and the charge transporting layer contains an arylaldehydehydrazone derivative of the general formula:

wherein $R^1$, $R^2$, $R^3$ and $R^4$ are each an alkyl or an aryl group.

14 Claims, 19 Drawing Sheets

LAMINATED ORGANIC PHOTOSENSITIVE MATERIAL

BACKGROUND OF THE INVENTION

1. Field of the Invention

This invention relates to a laminated organic photosensitive material which has a charge producing layer and a charge transporting layer formed on an electroconductive support and which is not only readily electrified, but also has a small residual potential. More particularly, the invention relates to a laminated organic photosensitive material which has a high sensitivity to a semiconductor laser region wavelength so as to be suitable for use as a photosensitive material for a laser beam printer.

2. Description of the Prior Art

A composite or laminated type organic photosensitive material has been developed and put to practical use in recent years. This type of organic photosensitive material is disclosed in, for example, Japanese Patent Publications Nos. 42380/1980 and 34099/1985. It comprises an electroconductive support, a charge producing layer formed on the support and a charge transporting layer formed on the charge producing layer. For instance, such a composite photosensitive material has an electroconductive support of aluminum layer, a charge producing layer formed on the aluminum layer, and a charge transporting layer formed on the charge producing layer.

The charge transporting layer is formed by, for example, preparing a dispersion of a charge transporting substance together with an organic solvent, a binder resin and, if necessary a plasticizer, applying the dispersion onto the support, and drying to a thin film. The charge producing layer is formed by, for example, dissolving a charge producing substance in an organic solvent together with a biner resin and, if required, a plasticizer, applying the solution onto the charge transporting layer, and drying to a thin film.

There are already known a variety of charge producing substances including phthalocyanine compounds, as disclosed in Japanese Patent Laid-Open No. 166959/1984. A number of charge transporting substances including hydrazone compounds are also already known, as disclosed in Japanese Patent Publications Nos. 42830/1980 and 34099/1985.

The hydrazone compound includes p-N,N-dialkylaminobenzaldehyde-N',N'-diphenylhydrazones, and in particular, p-N,N-diethylaminobenzaldehyde-N',N' diphenylhydrazone is preferred. p-N,N-diphenylaminobenzaldehyde-N'-methyl-N'-phenylhydrazone and p-N-ethyl-N-phenylaminobenzaldehyde-N'-methyl-N'-phenylhydrazone are also preferred.

In general, in the laminated organic photosensitive material, the charge transporting substance has a decisive bearing on the performance or quality of the photosensitive material. The manufacture of a photosensitive material of high sensitivity requires the provision of the charge transporting layer with the charge transporting substance in a relatively high concentration, and therefore the use of a charge transporting substance which is highly compatible with the binder resin. The substance must also be one from which a thin film can be formed easily. Moreover, the charge transporting substance is required to have an appropriately low oxidation potential and a high charge transfer rate so that the charge produced in the charge producing layer may be effectively injected into the charge transporting layer. However, an organic compound which has a low oxidation potential is generally sensitive to oxidation and hence is unstable.

None of the known hydrazone compounds as hereinabove mentioned is always satisfactory in view of the required properties as above set forth. The use of any such hydrazone derivative as a charge transporting substance still fails to provide any laminated organic photosensitive material of high sensitivity. None of any such known hydrazone derivative is satisfactory in stability, either.

Meanwhile, there has been a demand for a laminated organic photosensitive material for use in a laser beam printer which is sensitive to the long wavelength region from about 750 nm to about 850 nm, and the use of a variety of charge producing substances and charge transporting substances have hitherto been proposed. For instance, a number of phthalocyanine compounds including titanylphthalocyanine are disclosed for use as a charge producing substance as being sensitive to the long wavelength region as hereinabove mentioned in the Japanese Patent Laid-Open No. 166959/1984. However, none of them have been found to be charged and sensitive satisfactorily.

It is already known that X-type nonmetal phthalocyanine has a sensitivity to the long wavelength region, and a single layer photosensitive material is disclosed in U.S. Pat. No. 3,816,118. However, the photosensitive material has a very low sensitivity.

SUMMARY OF THE INVENTION

The present inventors have made an extensive investigation to solve the problems as above set forth involved in the known laminated organic photosensitive material, in particular to obtain a laminated organic photosensitive material having a high sensitivity to the long wavelength region. As results the inventors have found that the co-use of the X-type nonmetal phthalocyanine as a charge producing substance and a novel arylaldehydehydrazone compound as a charge transporting substance which is highly compatible with an organic binder and has an appropriately low oxidation potential and a high transfer rate as well as a high stability, provides a laminated organic photosensitive material very sensitive to the long wavelength region of 750–850 nm.

In accordance with the invention, there is provided a laminated organic photosensitive material which comprises an electroconductive support, a charge producing layer and a charge transporting layer formed thereon wherein the charge producing layer contains X-type nonmetal phthalocyanine as a charge producing substance and the charge transporting layer contains an arylaldehydehydrazone derivative of the general formula:

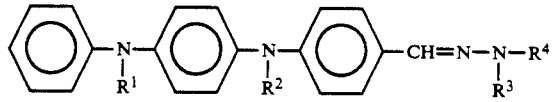

wherein $R^1$, $R^2$, $R^3$ and $R^4$ are each an alkyl or an aryl group, as a charge transporting substance.

The laminated organic photosensitive material of the invention contains X-type nonmetal phthalocyanine as a charge producing substance. It is represented by the formula:

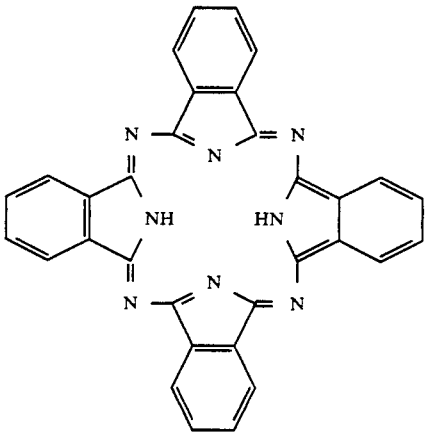

Figure 1:
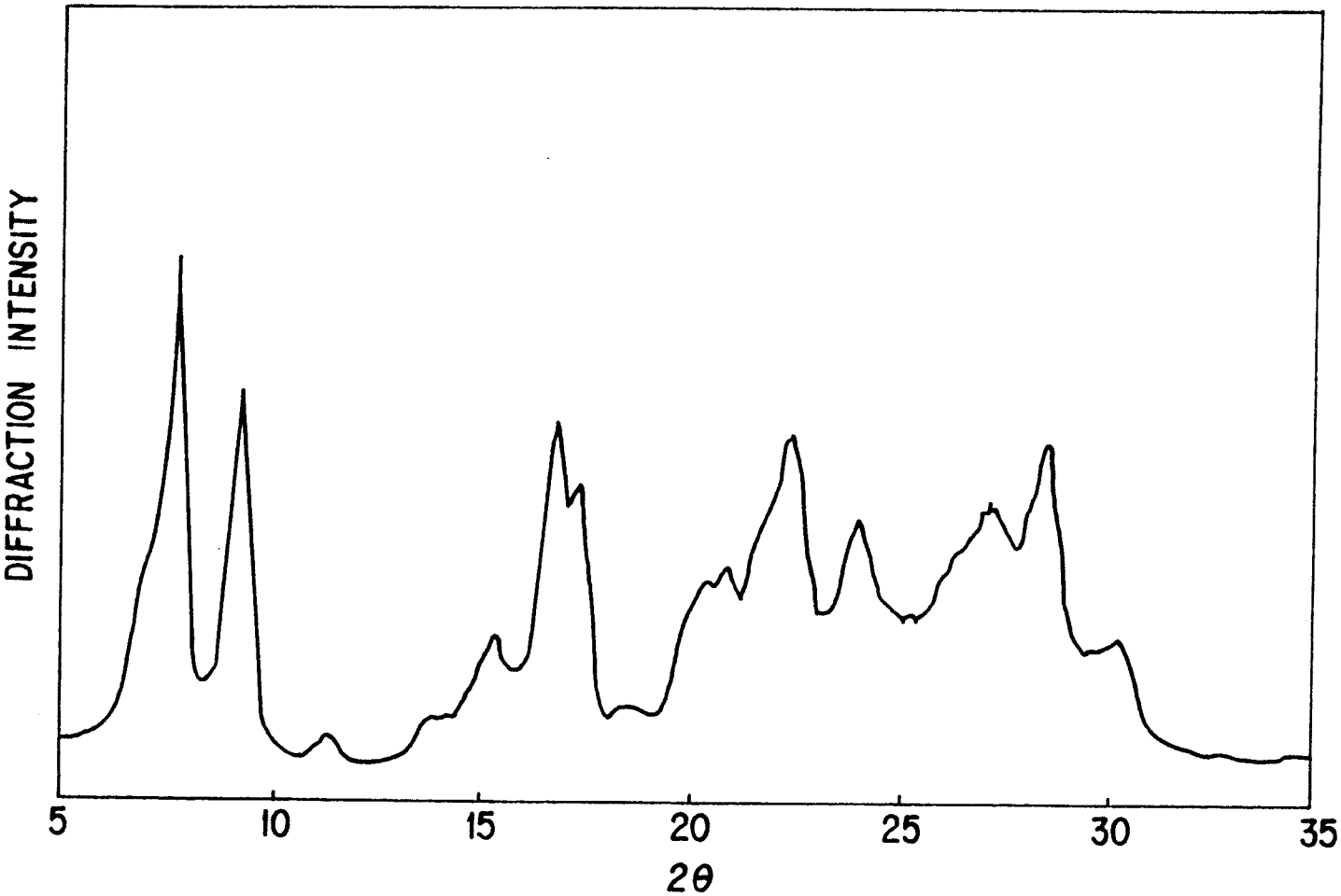
FIG. 1 is an X-ray diffraction diagram (CuK, α, powder method) of X-type nonmetal phthalocyanine used as a charge producing substance in the laminated organic photosensitive material of the invention.

FIG. 1 is an X-ray diffraction diagram (CuKα, powder method) of the X-type nonmetal phthalocyanine used as a charge transporting substance used in the invention.

The binder resin for the charge producing layer is not specifically limited, and it may be either a thermoplastic or thermosetting resin. The binder resin may be exemplified by, for example, polystyrene, styrene-acrylonitrile copolymer, styrene-butadiene copolymer, styrene-maleic anhydride copolymer, polyester resin, polyvinyl chloride, ethylene-vinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin.

The smaller the content of the binder resin in the charge producing layer, the better, but it is usually in the range of about 5–50% by weight based on the layer. The charge producing layer has a thickness usually of about 0.05–1 microns. The organic solvent used in the preparation of the charge producing layer is such that it dissolves the binder resin. Thus, the organic solvent used includes, for example, benzene, toluene, xylene, methylene chloride, chloroform, 1,2-dichloroethane, 1,1,2,2-tetrachloroethane, chlorobenzene, dichlorobenzene, ethyl acetate, butyl acetate, methyl ethyl ketone, dioxane, tetrahydrofuran, cyclohexanone, methyl cellosolve or ethyl cellosolve.

The laminated organic photosensitive material of the invention has a charge transporting layer on the charge producing layer. The charge transporting layer contains the novel arylaldehydehydrazone derivative as hereinbefore mentioned. The aryl group may have substituents.

In the general formula hereinbefore presented, the alkyl group may, for example, be a methyl, ethyl, propyl, butyl, pentyl, hexyl, octyl, nonyl or dodecyl group. It may be in the form of a straight or branched chain. The aryl group may, for example, be an unsubstituted or a substituted phenyl, naphthyl, anthryl, pyrenyl, acenaphthenyl or fluorenyl group. If it is a substituted one, the substituent may, for example, be an alkyl group such as methyl, ethyl, propyl, butyl, pentyl, hexyl, octyl, nonyl or dodecyl, an alkoxy group such as methoxy, ethoxy, propoxy or butoxy, a halogen such as chlorine, bromine or fluorine, an aryloxy group such as phenoxy or tolyloxy, or a dialkylamino group such as dimethylamino, diethylamino or dipropylamino.

According to a preferred aspect of the invention, however, $R^1$, $R^2$, $R^3$ and $R^4$ are each methyl, ethyl, propyl, butyl, phenyl, tolyl or chlorophenyl.

The following compounds can, therefore, be given as specific preferred examples of the charge transporting substance according to the invention:

p-[(p-diphenylaminophenyl)phenyl]aminobenzaldehydemethylphenylhydrazone (1)

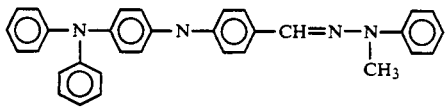

p-[(p-phenyl-p-tolylamino)phenyl)-p-tolyl]-aminobenzaldehydemethylphenylhydrazone (2)

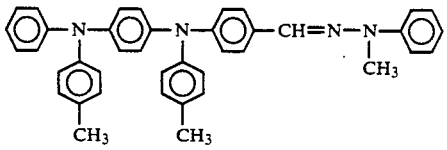

p-[(p-(phenyl-p-chlorophenyl)phenyl)-p-chlorophenyl]aminobenzaldehydediphenylhydrazone (3)

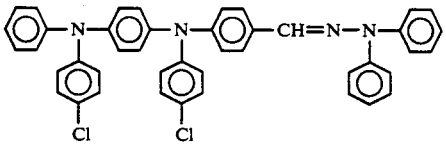

p-[(p-(phenyl-p-chlorophenyl)phenyl)-p-chlorophenyl]aminobenzaldehydemethylphenylhydrazone (4)

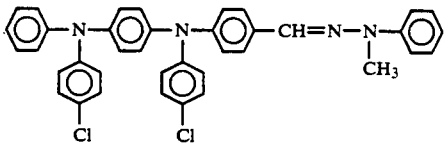

p-[(p-diphenylaminophenyl)phenyl]aminobenzaldehydemethyl-p-chlorophenylhydrazone (5)

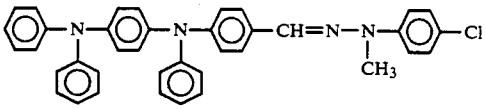

p-[(p-methylphenylamino)phenyl)methyl]amiobenzaldehydediphenylhydrazone (6)

-continued

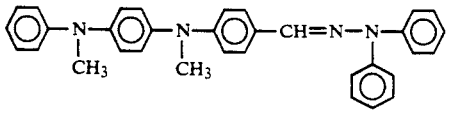

p-[(p-diphenylaminophenyl)phenyl]aminobenzaldehydediphenylhydrazone (7)

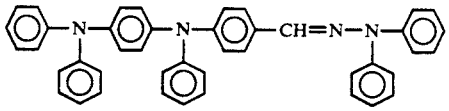

p-[(p-(phenyl-p-tolylamino)phenyl)-p-tolyl]aminobenzaldehydediphenylhydrazone (8)

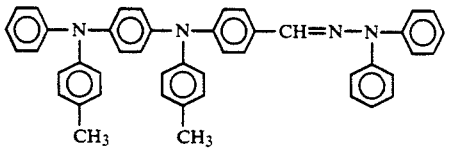

p-[(p-(phenyl-m-tolylamino)phenyl)-m-tolyl]aminobenzaldehydediphenylhydrazone (9)

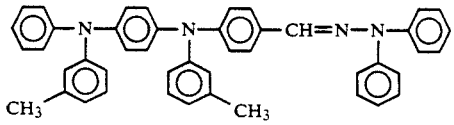

p-[(p-(phenyl-m-tolylamino)phenyl)-m-tolyl]aminobenzaldehydemethylphenylhydrazone (10)

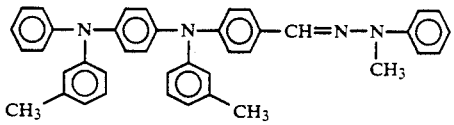

p-[(p-phenylethylaminophenyl)ethyl]aminobenzaldehydediphenylhydrazone (11)

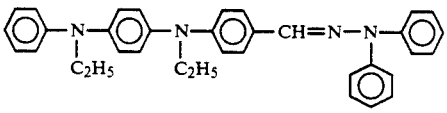

p-[(p-(methylphenylamino)phenyl)methyl]aminobenzaldehydemethylphenyhydrazone (12)

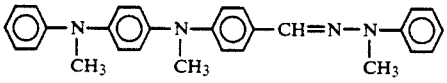

Any of these arylaldehydehydrazone derivatives can be produced by reacting the corresponding arylaldehyde with hydrazine appropriately in accordance with any conventional method which is employed for the production of aldehydehydrazones.

These arylaldehydehydrazone derivatives are highly compatible with a binder resin and they also have an appropriately low oxidation potential, but also they show complete reversibility in an oxidation-reduction reaction and one hence very stable.

The binder resin for the charge transporting layer is of the type which is soluble in an organic solvent and is highly compatible with the charge transporting substance so that a stable solution thereof may be prepared easily. Moreover, it is preferable to use a resin which is inexpensive and can form a film of high mechanical strength, transparency and electrical insulation. Preferred examples of the binder resin may be exemplified by, for example, polystyrene, styrene-acrylonitrile copolymer, styrenebutadiene copolymer, styrene-maleic anhydride copolymer, polyester resin, polyvinyl chloride, ethylene-vinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin.

The organic solvent used for the preparation of the charge transporting layer may include, for example, tetrahydrofuran, dioxane, toluene, chlorobenzene, methylene chloride, chloroform, 1,2-dichloroethane or 1,1,2,2-tetrachloroethane.

The content of the charge transporting substance in the charge transporting layer is usually in the range of about 10-60% by weight based on the layer, and the thickness of the layer is usually in the range of about 5-10 microns.

The laminated organic photosensitive material is manufactured by applying a mixture of X-type nonmetal phthalocyanine as a charge producing substance, a binder resin, an organic solvent and, if necessary, a plasticizer onto an electroconductive support, drying the coated layer to form a charge producing layer, and then applying a solution of the charge transporting substance, a binder resin and, if necessary a plasticizer, in an organic solvent, and then drying the coated layer to form a charge transporting layer. However, the laminated organic photosensitive material of the invention may have a charge transporting layer on an electroconductive support, and a charge producing layer on the charge transporting layer.

The invention will now be described more specifically with reference to examples, however, the invention is not limited thereto. Prior to the description of these examples, however, there will be described reference examples which are directed to the preparation of the arylaldehydehydrazone derivatives, and which are not intended for limiting the scope of the invention, either.

REFERENCE EXAMPLE 1

Synthesis of p-[(p-diphenylaminophenyl)phenyl]aminobenzaldehydemethylphenylhydrazone—Compound (1)

An amount of 50 g (0.114 mol) of p-[(p-diphenylaminophenyl)phenyl]aminobenzaldehyde and 27.7 g (0.227 mol) of methylphenylhydrazine were reacted at a reflux temperature for two hours in two liters of tetrahydrofuran in a flask having a nitrogen atmosphere.

After the completion of the reaction, the solvent was removed by distillation, whereby an oily matter was obtained. The oily matter was purified and separated by silica gel chromatography employing benzene, and then recrystallized twice from a mixed solvent of benzene and ethanol (1/1), to provide 38.0 g (yield: 62%) of the compound as fine, pale yellow crystals.

Melting point: 179°-180° C.

Mass Analysis: Molecular ion peak 544 Elemental Analysis:

| Elemental Analysis: | C | H | N |
|---|---|---|---|
| Calculated | 83.79 | 5.92 | 10.29 |
| Observed | 83.87 | 5.97 | 10.09 |

Figure 2:
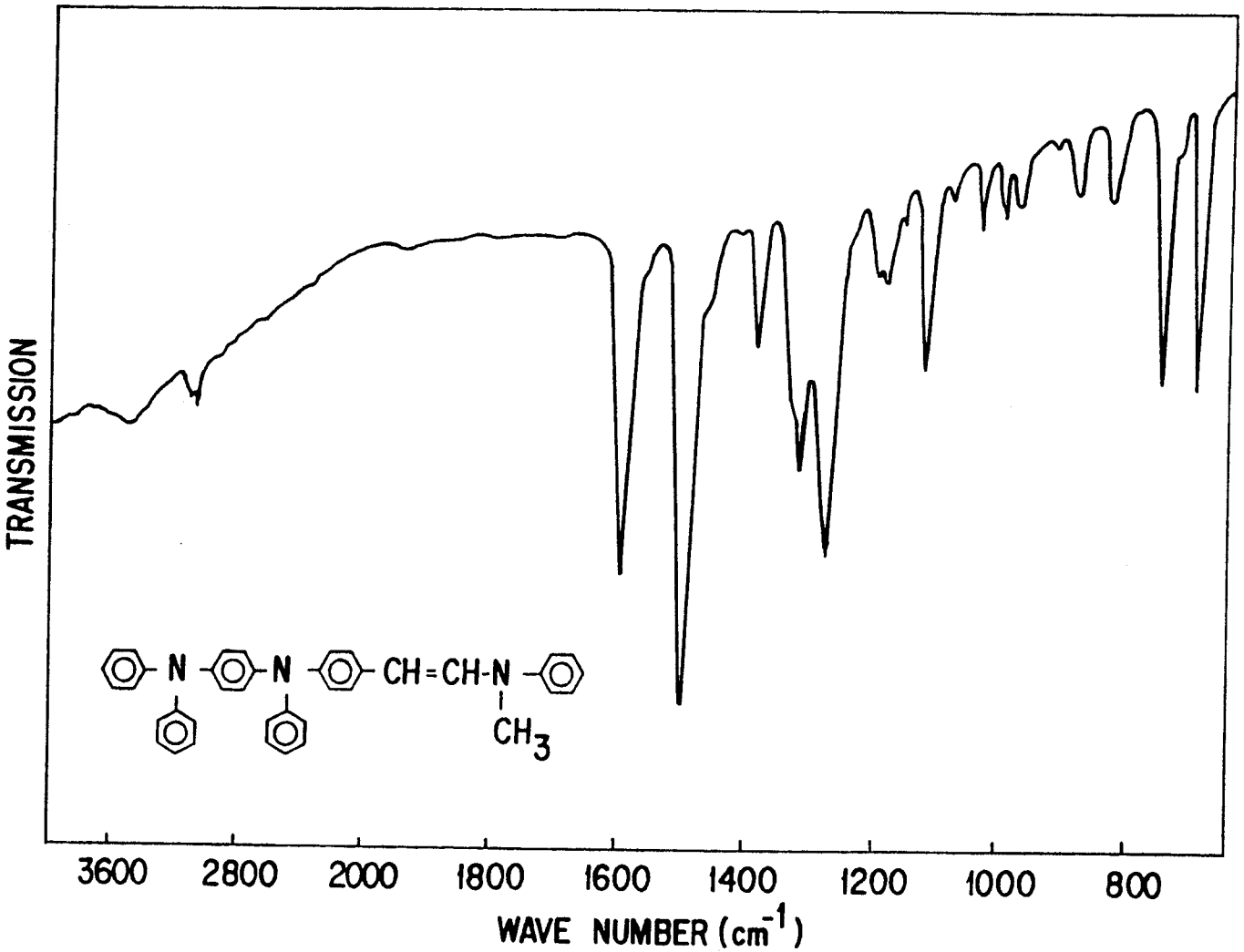
FIGS. 2 to 19 are each an infrared absorption spectrum or a cyclic voltamogram of an arylaldehydehydrazone derivative employed as a charge transporting substance in the laminated organic photosensitive material of the invention.
Figure 3:
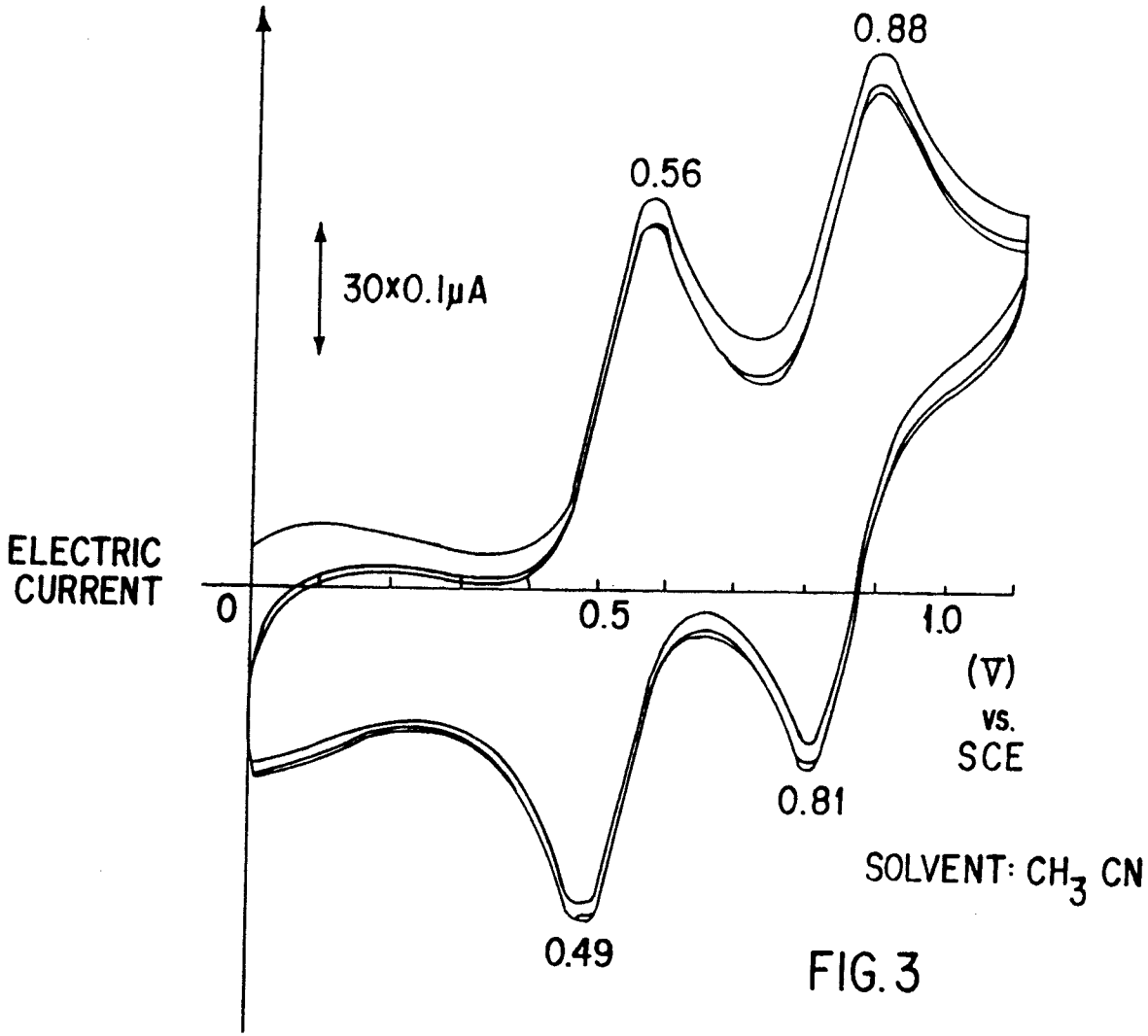

The infrared absorption spectrum of the compound is shown in FIG. 2, and the cyclic voltamogram in FIG. 2. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 2

Synthesis of p-[(p-(phenyl-p-tolylamino)phenyl)-p-tolyl]aminobenzaldehydemethylphenylhydrazone—Compound (2)

An amount of 50 g (0.107 mol) of p-[(p-(phenyl-p-tolylamino)phenyl)-p-tolyl]aminobenzaldehyde and 26.1 g (0.213 mol) of methylphenylhydrazine were reacted at a reflux temperature for two hours in two liters of tetrahydrofuran in a flask having a nitrogen atmosphere.

After the completion of the reaction, the solvent was removed by distillation, whereby an oily matter was obtained. The oily matter was purified and separated by silica gel chromatography employing benzene, and then recrystallized twice from a mixed solvent of benzene and ethanol (1/1), to provide 38.0 g (yield: 62%) of the compound as fine, pale yellow crystals.

Melting point: 184.5°-185.5° C.

Mass Analysis: Molecular ion peak 572

| Elemental Analysis: | C | H | N |
|---|---|---|---|
| Calculated | 83.88 | 6.34 | 9.78 |
| Observed | 83.96 | 6.34 | 9.51 |

Figure 4:
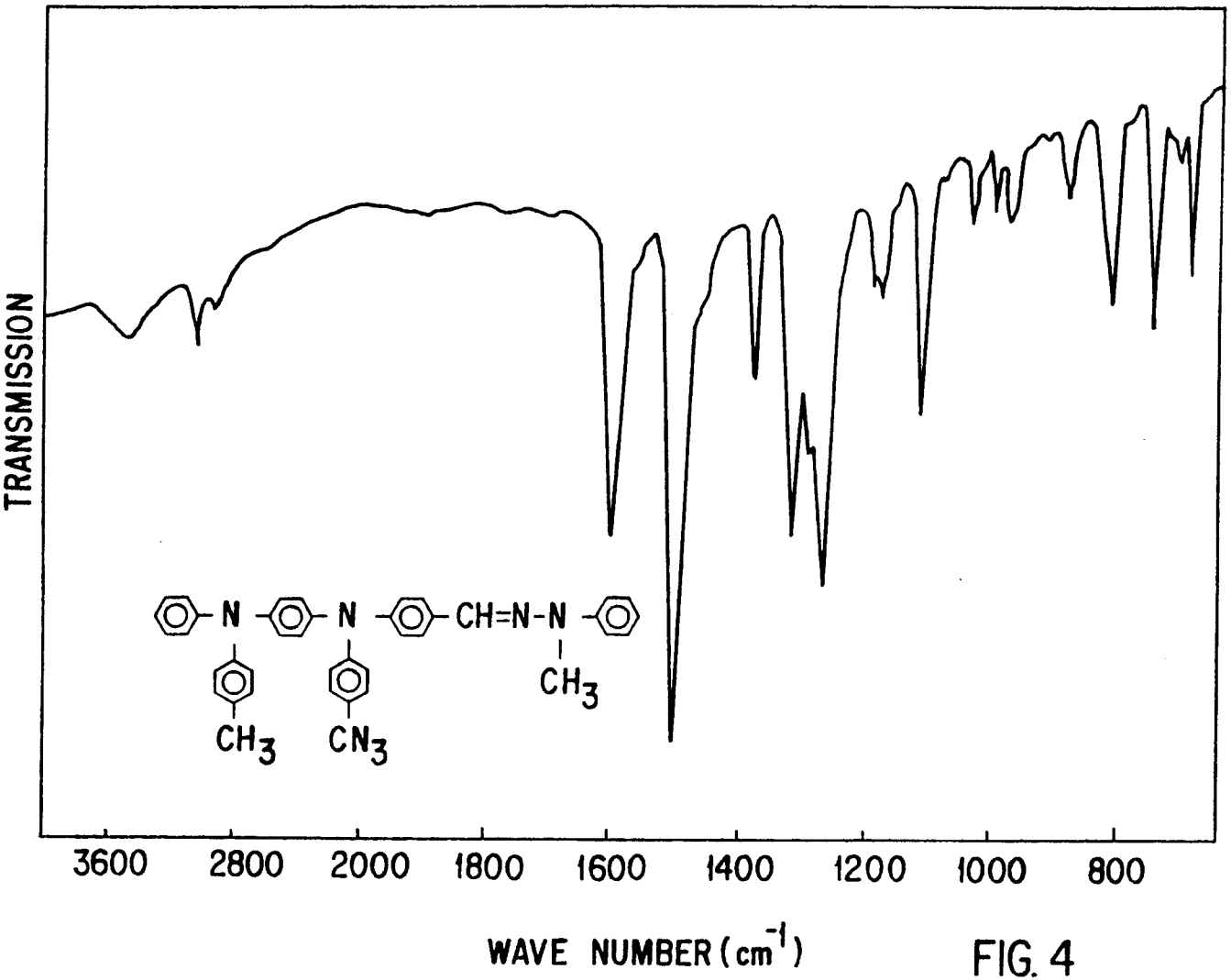
Figure 5:
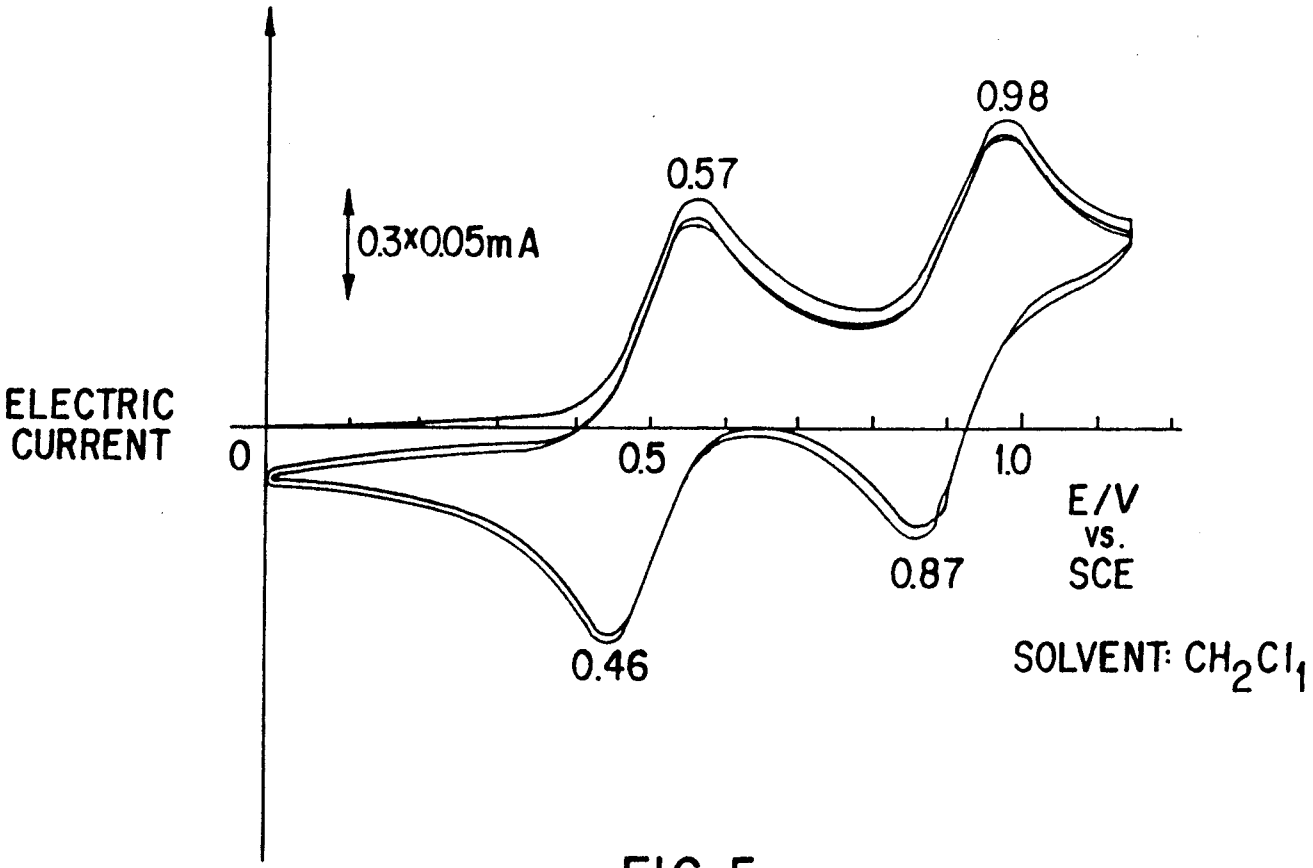

The infrared absorption spectrum of the compound is shown in FIG. 4, and the cyclic voltamogram in FIG. 5. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 3

Synthesis of p-[(p-(phenyl-p-chlorophenyl)phenyl)-p-chlorophenyl-]aminobenzaldehydediphenylhydrazone—Compound (3)

An amount of 100 g (0.196 mol) of p-[(p-(phenyl-p-chlorophenyl)phenyl)-p-chlorophenyl]aminobenzaldehyde, 151 g (0.589 mol) of diphenylhydrazine hydrochloride and 66 g (0.784 mol) of sodium hydrogen carbonate were reacted at a reflux temperature for three hours in three liters of tetrahydrofuran in a flask having a nitrogen atmosphere.

After the completion of the reaction, the undissolved inorganic matter was removed by filtration, and the solvent by distillation, whereby an oily matter was obtained. The oily matter was purified and separated by silica gel chromatography employing a mixed solvent of benzene and hexane (1/1), and then recrystallized twice from a mixed solvent of benzene and ethanol (3/2), to provide 95 g (yield: 72%) of the compound as fine, pale yellow crystals.

Melting point: 199.5°-201.0° C.

Mass Analysis: Molecular ion peak 675

| Elemental Analysis: | C | H | N |
|---|---|---|---|
| Calculated | 76.44 | 4.77 | 8.29 |
| Observed | 76.38 | 4.84 | 8.08 |

Figure 6:
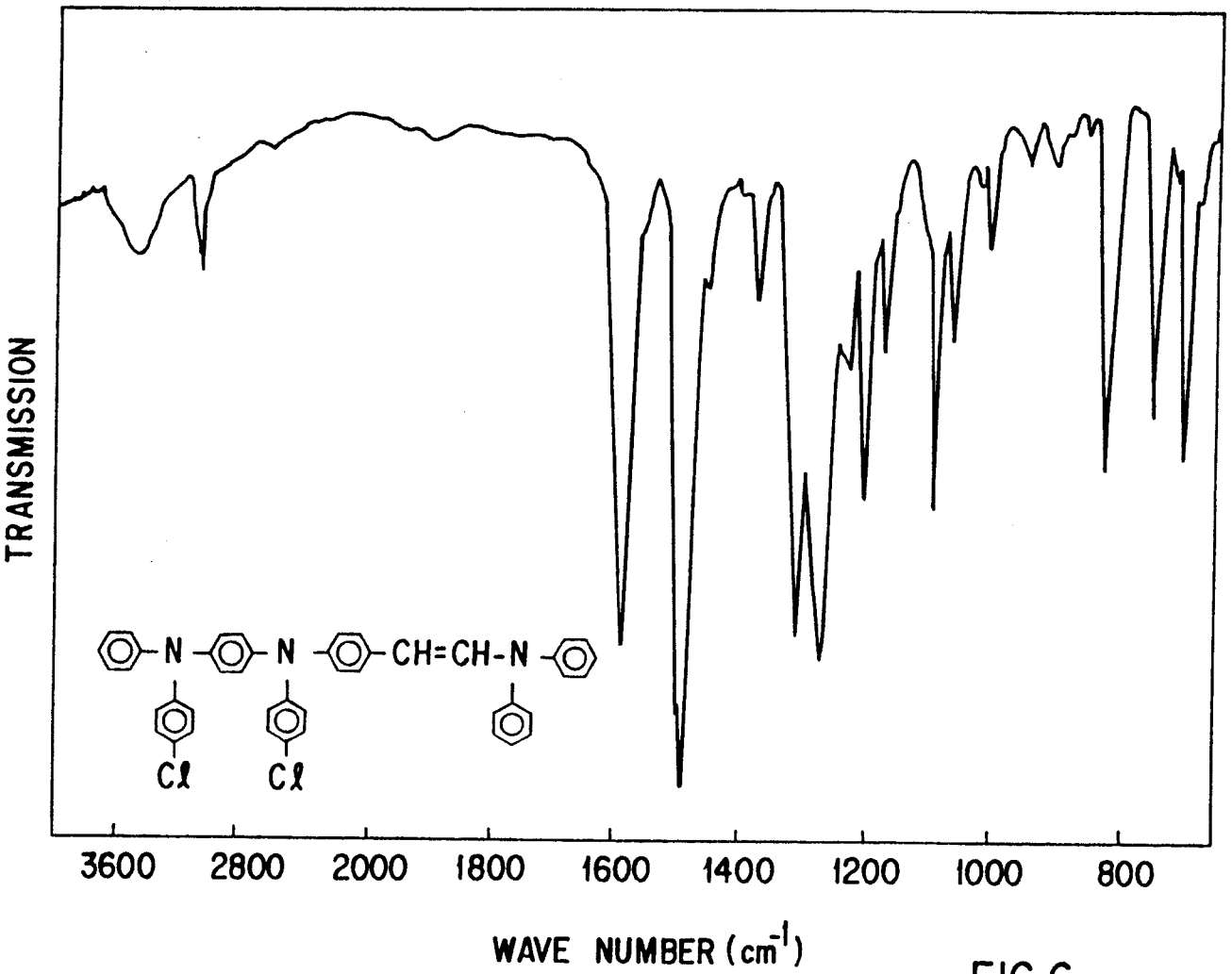
Figure 7:
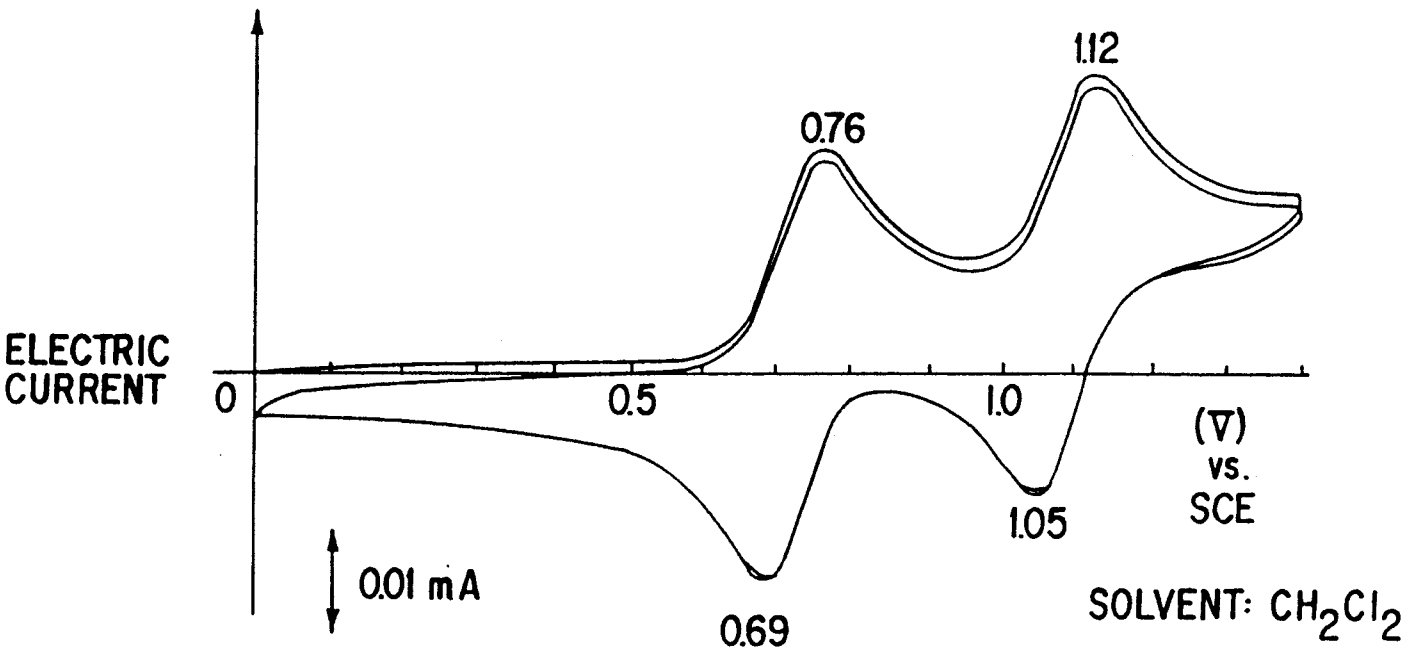

The infrared absorption spectrum of the compound is shown in FIG. 6, and the cyclic voltamogram in FIG. 7. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 4

Synthesis of p-[(p-(phenyl-p-chlorophenyl)phenyl)-p-chlorophenyl-]aminobenzaldehydemethylphenylhydrazone—Compound (4)

An amount of 22 g (0.043 mol) of p-[(p-(phenyl-p-chlorophenyl)phenyl)-p-chlorophenyl]aminobenzaldehyde and 10.6 g (0.086 mol) of methylphenylhydrazine were reacted at a reflux temperature for two hours in two liters of tetrahydrofuran in a flask having a nitrogen atmosphere.

After the completion of the reaction, the solvent was removed by distillation, whereby an oily matter was obtained. The oily matter was purified and separated by silica gel chromatography employing benzene, and then recrystallized twice from a mixed solvent of benzene and ethanol (1/1), to provide 17.0 g (yield: 64%) of the compound as fine, pale yellow crystals.

Melting point: 189°-192° C.

Mass Analysis: Molecular ion peak 612 Elemental Analysis:

| Elemental Analysis: | C | H | N |
|---|---|---|---|
| Calculated | 74.39 | 4.93 | 9.13 |
| Observed | 74.59 | 4.97 | 9.01 |

Figure 8:
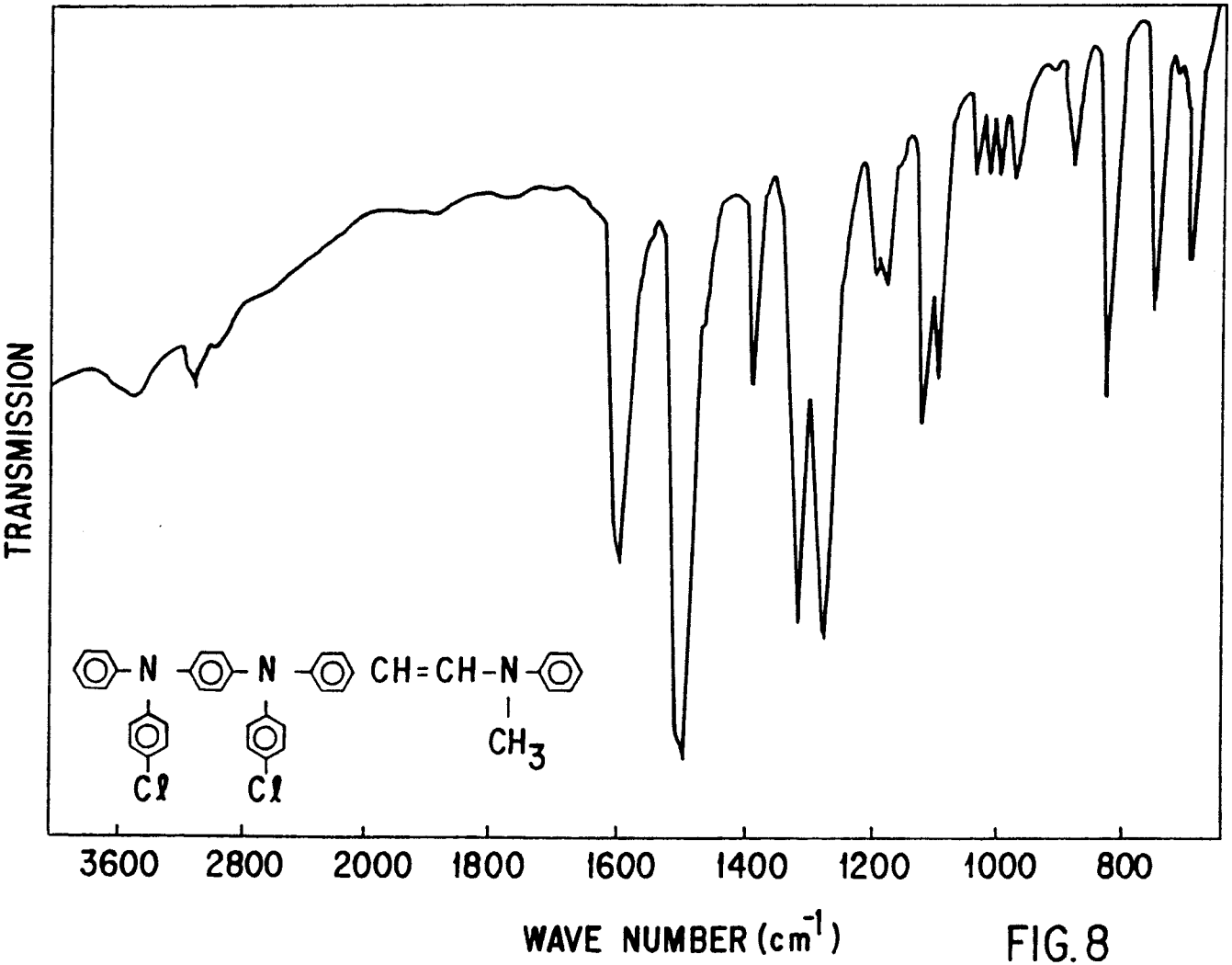
Figure 9:
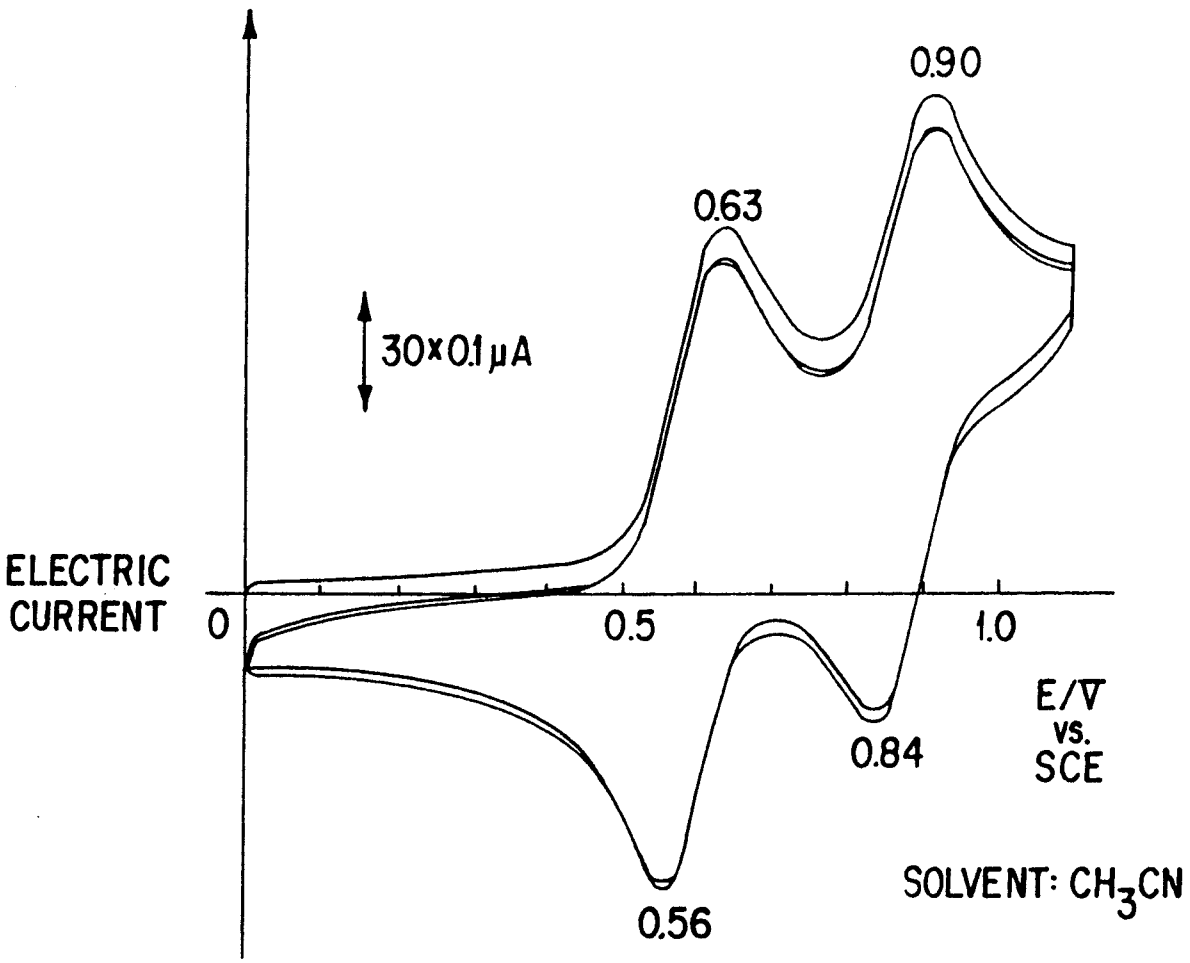

The infrared absorption spectrum of the compound is shown in FIG. 8, and the cyclic voltamogram in FIG. 9. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 5

Synthesis of p-[(p-diphenylaminophenyl)phenyl]aminobenzaldehydemethyl-p-chlorophenylhydrazone—Compound (5)

An amount of 4.6 g (0.010 mol) of p-[(p-diphenylaminophenyl)phenyl]aminobenzaldehyde and 4.9 g (0.031 mol) of methyl-p-chlorophenylhydrazine were reacted at a reflux temperature for four hours in 300 ml of tetrahydrofuran in a flask having a nitrogen atmosphere.

After the completion of the reaction, the solvent was removed by distillation, whereby an oily matter was obtained. The oily matter was purified and separated by silica gel chromatography employing benzene, and then recrystallized twice from a mixed solvent of benzene and ethanol (1/1), to provide 3.7 g (yield: 61%) of the compound as fine, pale yellow crystals.

Melting point: 110° C.

Mass Analysis: Molecular ion peak 578 Elemental Analysis:

| Elemental Analysis: | C | H | N |
|---|---|---|---|
| Calculated | 78.81 | 5.40 | 9.67 |
| Observed | 78.80 | 5.39 | 9.51 |

Figure 10:
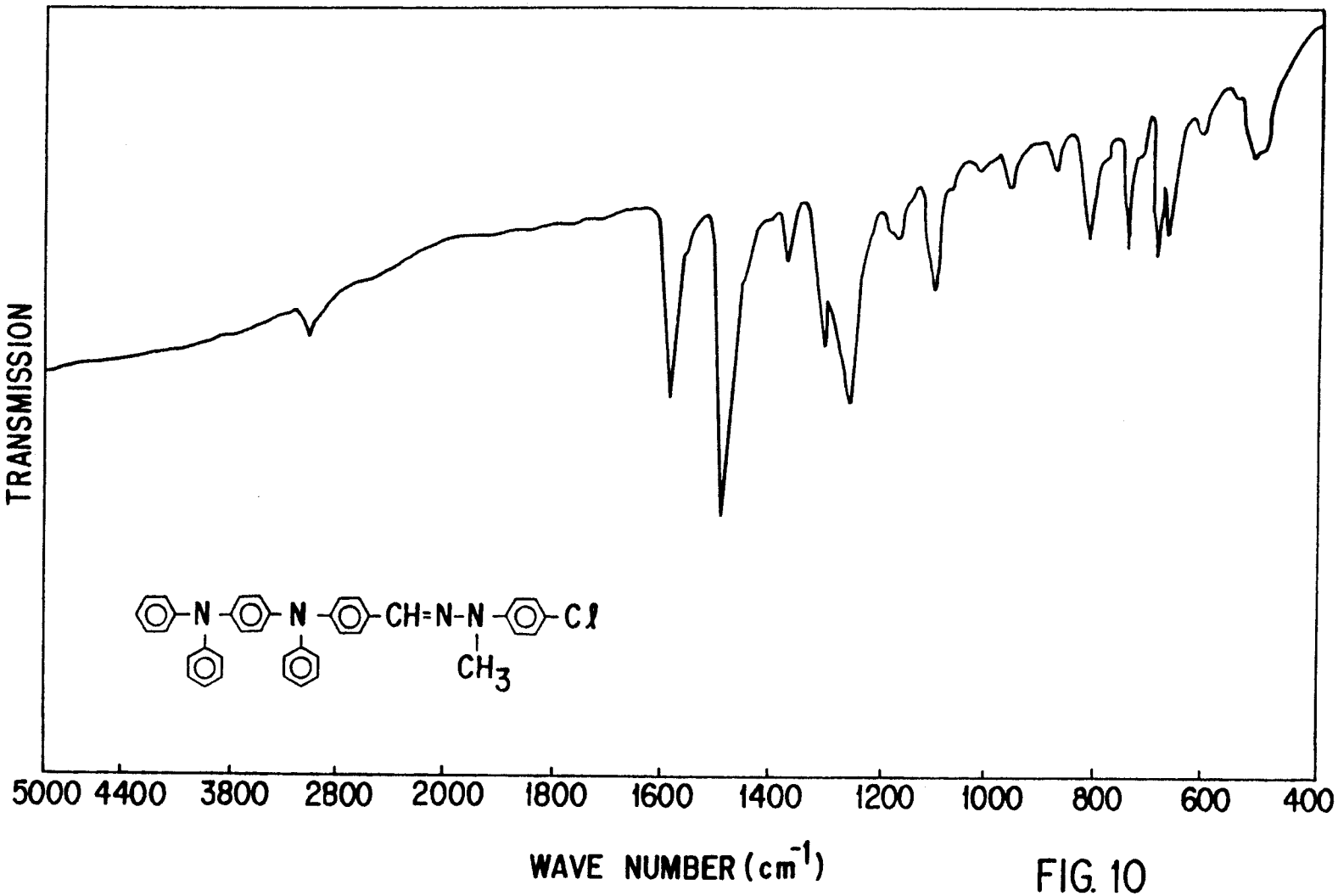
Figure 11:
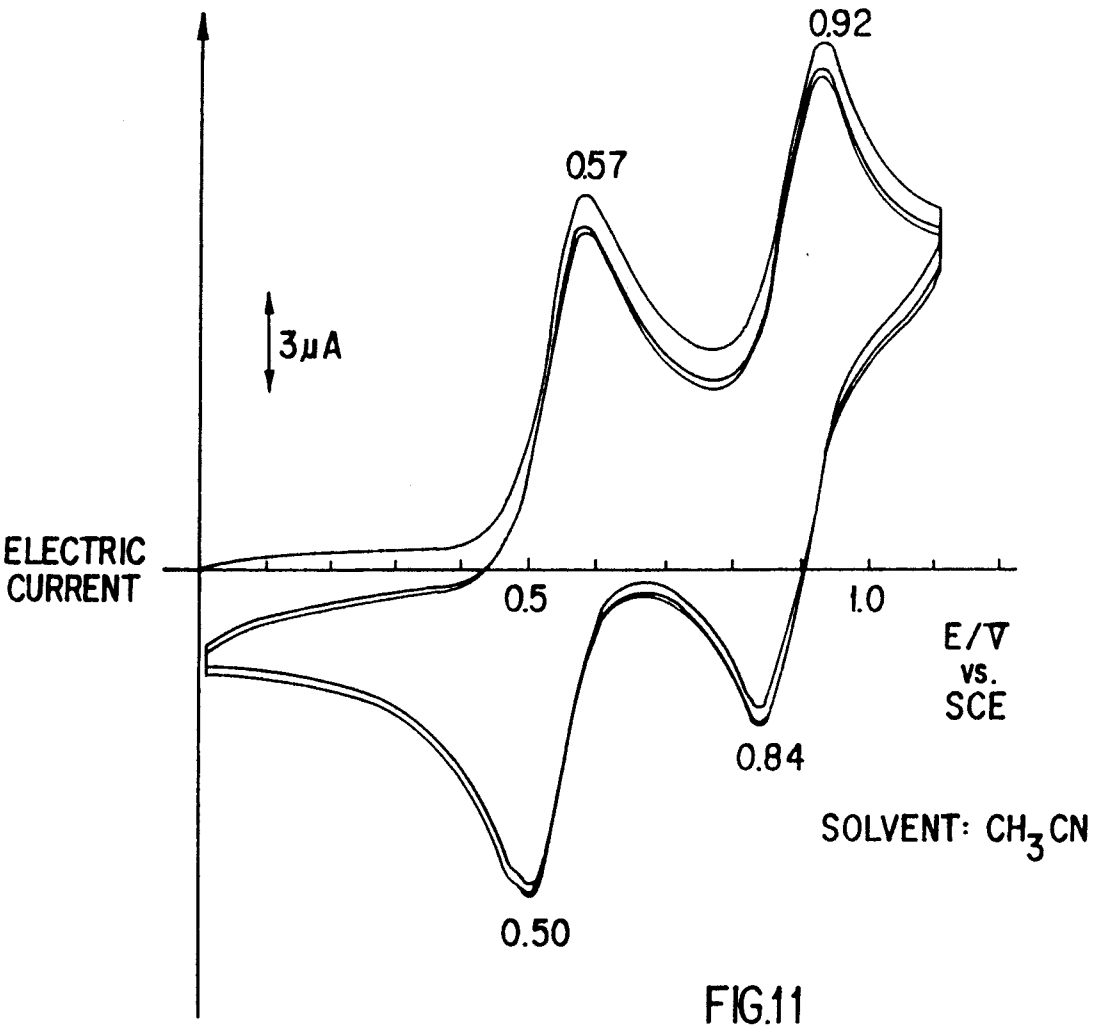

The infrared absorption spectrum of the compound is shown in FIG. 10, and the cyclic voltamogram in FIG. 11. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 6

Synthesis of p-[(p-methylphenylamino)phenyl)methyl]-aminobenzaldehydediphenylhydrazone—Compound (6)

An amount of 10 g (0.032 mol) of p-[(p-methylphenylamino)phenyl)methyl]aminobenzaldehyde, 12.2 g (0.047 mol) of diphenylhydrazine hydrochloride and 4.2 g (0.05 mol) of sodium hydrogen carbonate were reacted at a reflux temperature for four hours in 200 ml of tetrahydrofuran in a flask having a nitrogen atmosphere.

After the completion of the reaction, the undissolved inorganic matter was removed by filtration, and the solvent by distillation, whereby an oily matter was obtained. The oily matter was purified and separated by silica gel chromatography employing a mixed solvent of benzene and hexane (1/1), and then recrystallized twice from a mixed solvent of benzene and ethanol (1/5), to provide 7.3 g (yield: 48%) of the compound as fine, pale yellow crystals.

Melting point: 115°-117° C.

Mass Analysis: Molecular ion peak 482 Elemental Analysis:

| Elemental Analysis: | C | H | N |
|---|---|---|---|
| Calculated | 82.13 | 6.27 | 11.61 |
| Observed | 82.04 | 6.21 | 11.58 |

Figure 12:
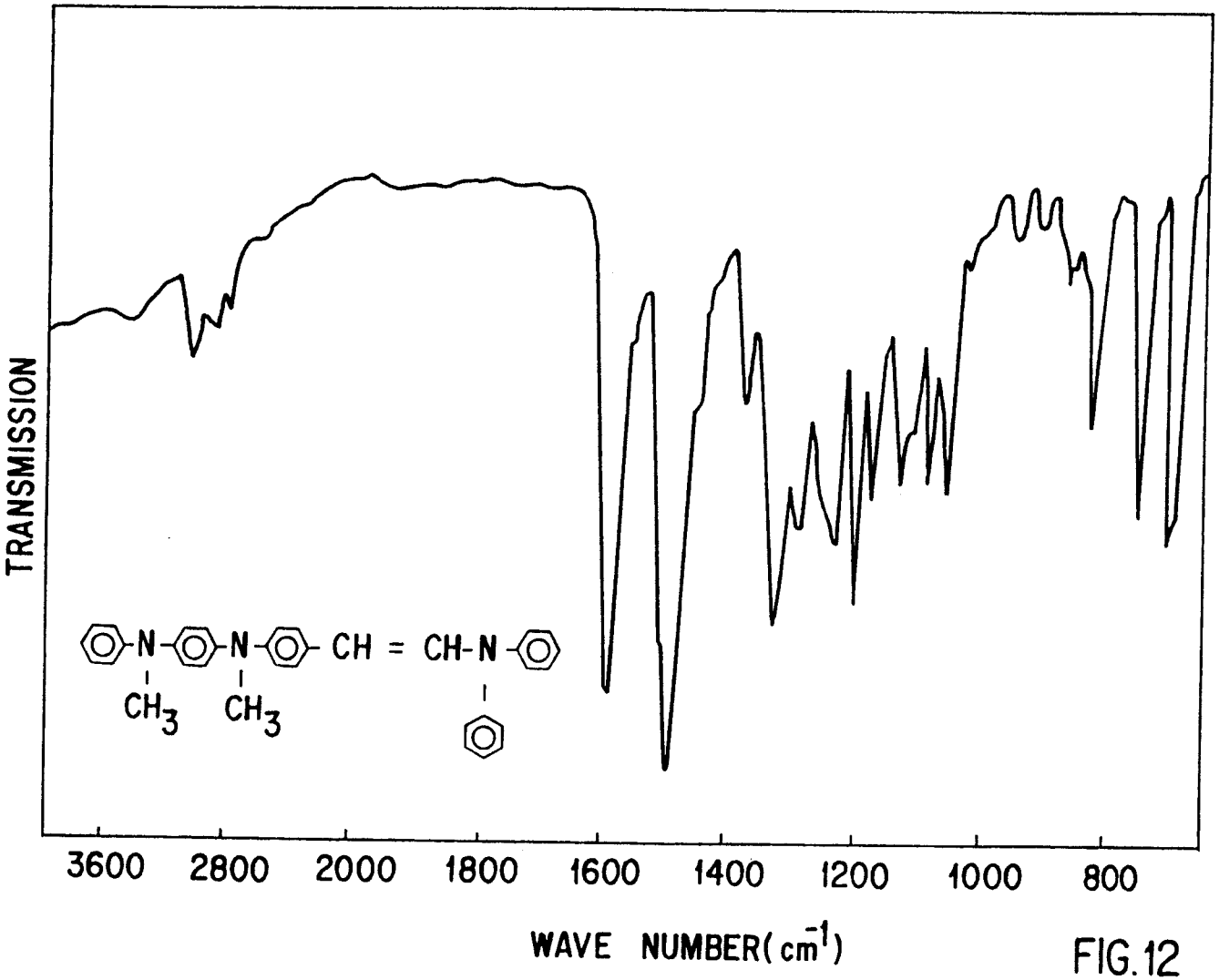
Figure 13:
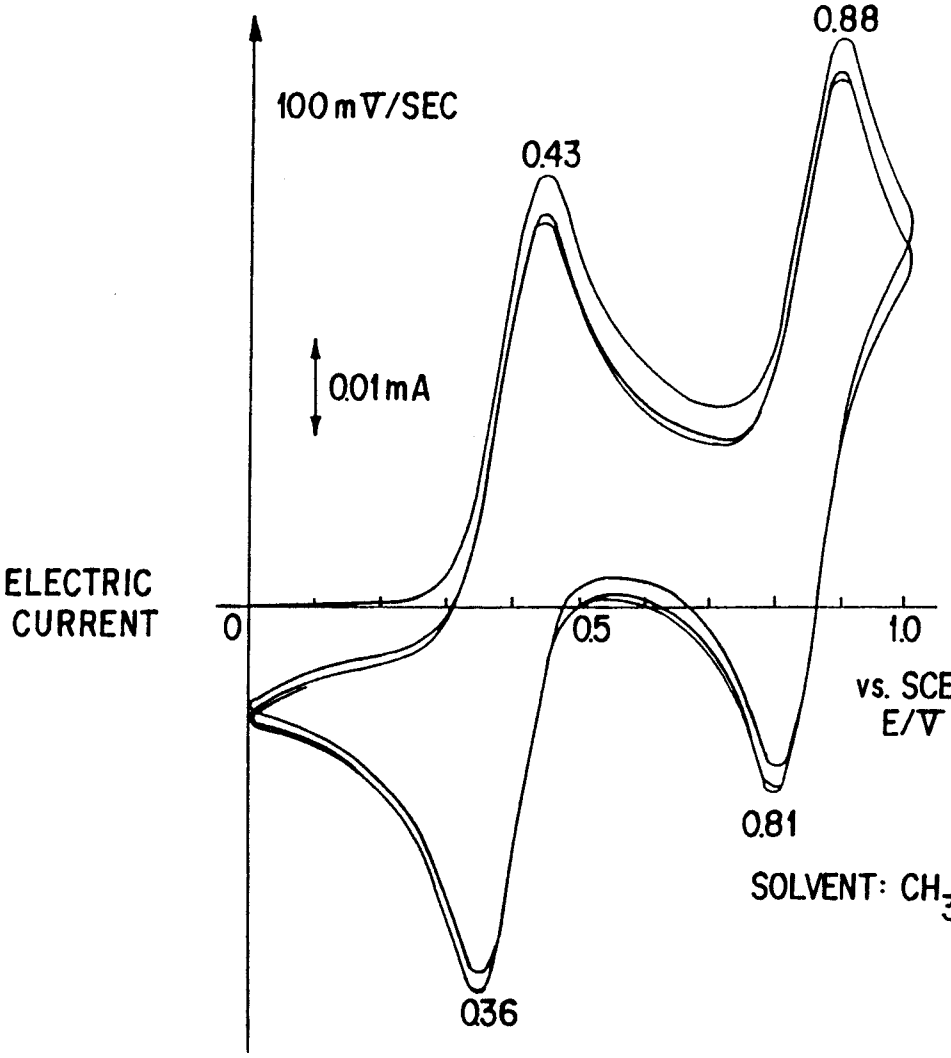

The infrared absorption spectrum of the compound is shown in FIG. 12, and the cyclic voltamogram in FIG. 13. It showed complete reversibility in an oxidation-reduction reaction. A compatibilized composition was prepared by dissolving the compound in polycarbonate in equal proportions by weight and its charge transfer rate is shown in Table 1.

REFERENCE EXAMPLE 7

Synthesis of p-[(p-diphenylaminophenyl)phenyl]aminobenzaldehydediphenylhydrazone—Compound (7)

An amount of 70 g (0.159 mol) of p-[(p-diphenylaminophenyl)phenyl]aminobenzaldehyde, 61.3 g (0.238 mol) of diphenylhydrazine hydrochloride and 14.3 g (0.357 mol) of sodium hydroxide were reacted at a reflux temperature for two hours in five liters of ethanol in a flask having a nitrogen atmosphere, to provide a pale yellow precipitate.

The precipitate was collected by filtration, washed with a small amount of methanol and dissolved in hot toluene. The solution was filtered during hot to remove inorganic salts therefrom. The filtrate was recrystallized twice from toluene to provide 29 g (yield: 30.1%) of the compound as fine, pale yellow crystals.

Melting point: 230.0°-231.5° C.

Mass Analysis: Molecular ion peak 606 Elemental Analysis:

| Elemental Analysis: | C | H | N |
|---|---|---|---|
| Calculated | 85.12 | 5.65 | 9.23 |
| Observed | 85.18 | 5.72 | 9.00 |

Figure 14:
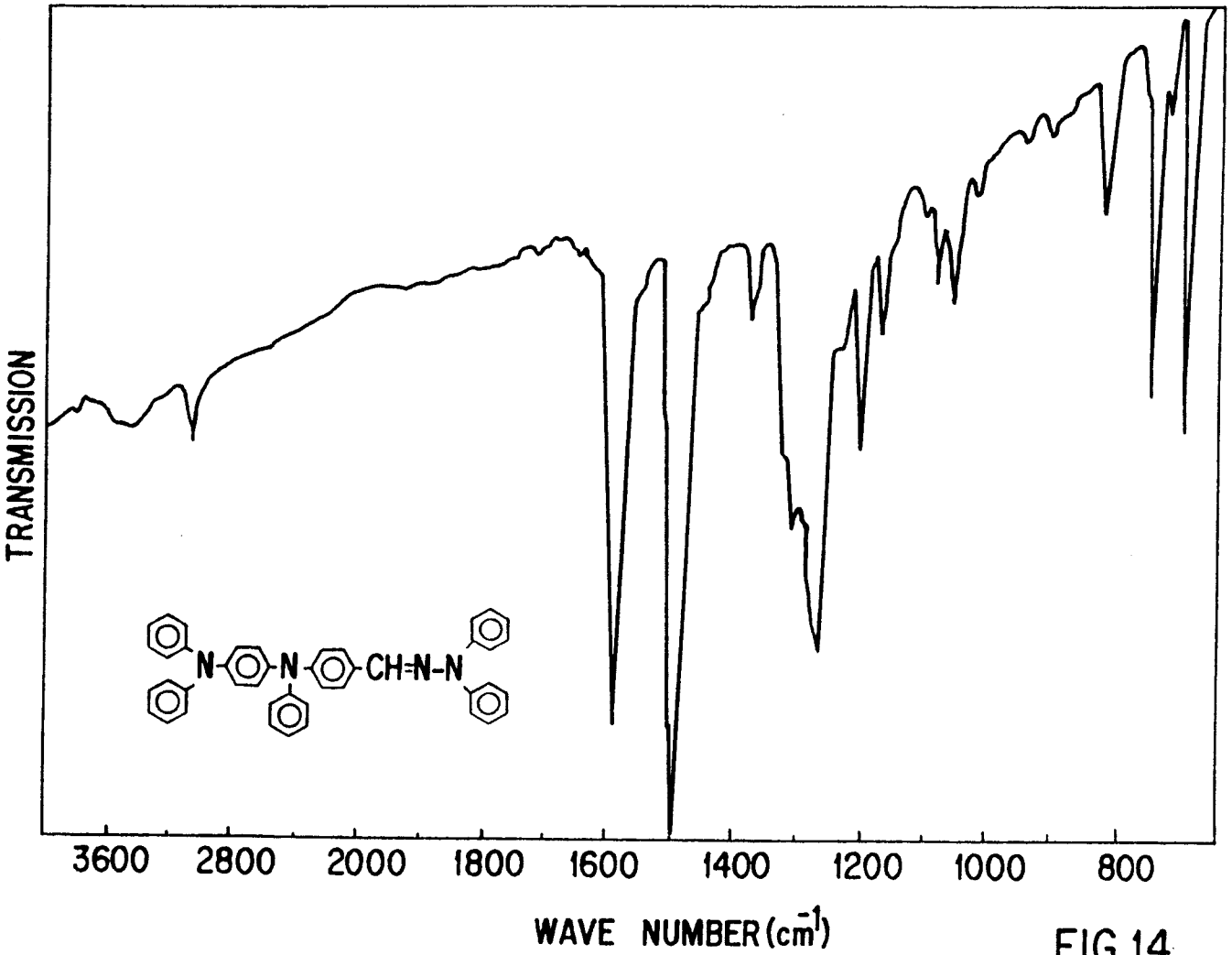
Figure 15:
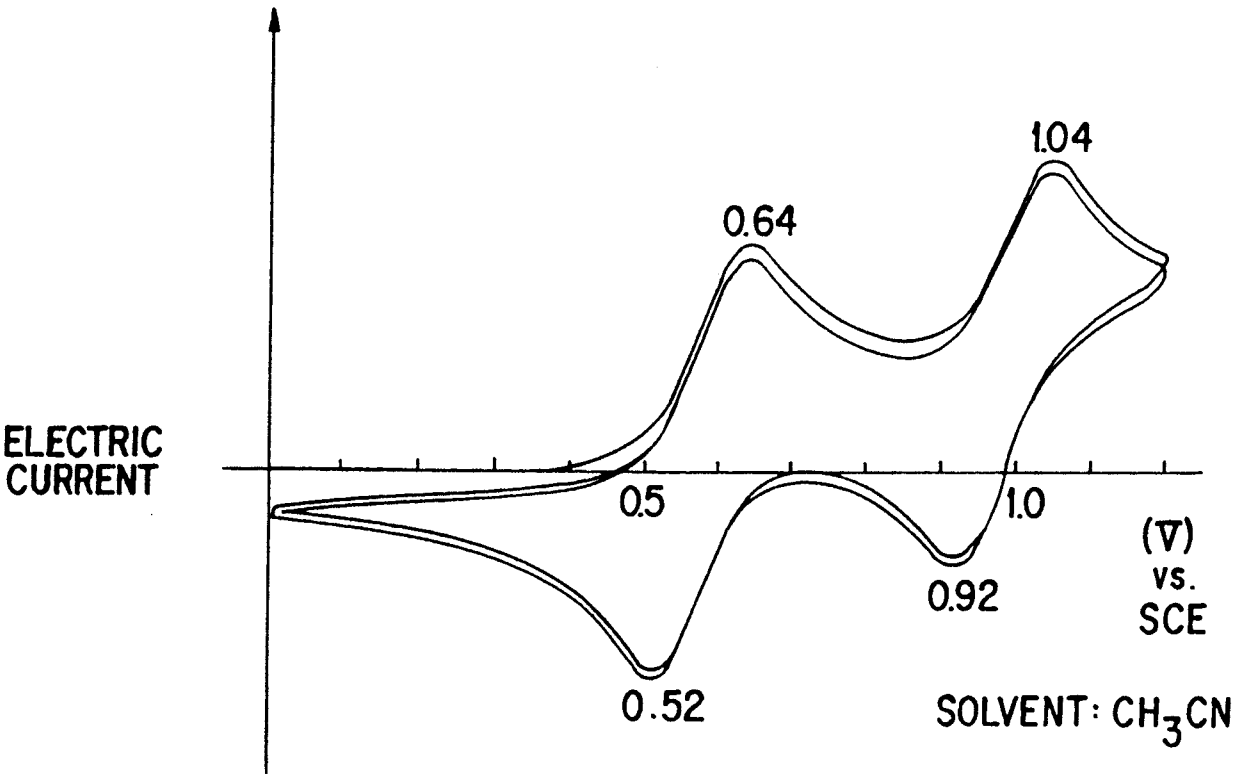

The infrared absorption spectrum of the compound is shown in FIG. 14, and the cyclic voltamogram in FIG. 15. It showed complete reversibility in an oxidation-reduction reaction.

REFERENCE EXAMPLE 8

Synthesis of p-[(p-phenyl-p-tolylamino)phenyl)-p-tolyl]aminobenzaldehydediphenylhydrazone—Compound (8)

An amount of 80 g (0.171 mol) of p-[(p-phenyl-p-tolylamino)phenyl)-p-tolyl]aminobenzaldehyde, 132.8 g (0.514 mol) of diphenylhydrazine hydrochloride and 30.8 g (0.772 mol) of sodium hydroxide were reacted at a reflux temperature for six hours in six liters of ethanol in a flask having a nitrogen atmosphere, to provide a pale yellow precipitate.

The precipitate was collected by filtration, washed with a small amount of methanol and dissolved in benzene. The solution was filtered to remove inorganic salts therefrom. The solution was then recrystallized twice from a mixed solvent of benzene and ethanol (2/3) to provide 50 g (yield: 46.1%) of the compound as fine, pale yellow crystals.

Melting point: 193.5°-195.0° C.

Mass Analysis: Molecular ion peak 634 Elemental Analysis:

| Elemental Analysis: | C | H | N |
|---|---|---|---|
| Calculated | 85.14 | 6.03 | 8.83 |
| Observed | 85.16 | 6.08 | 8.76 |

Figure 16:
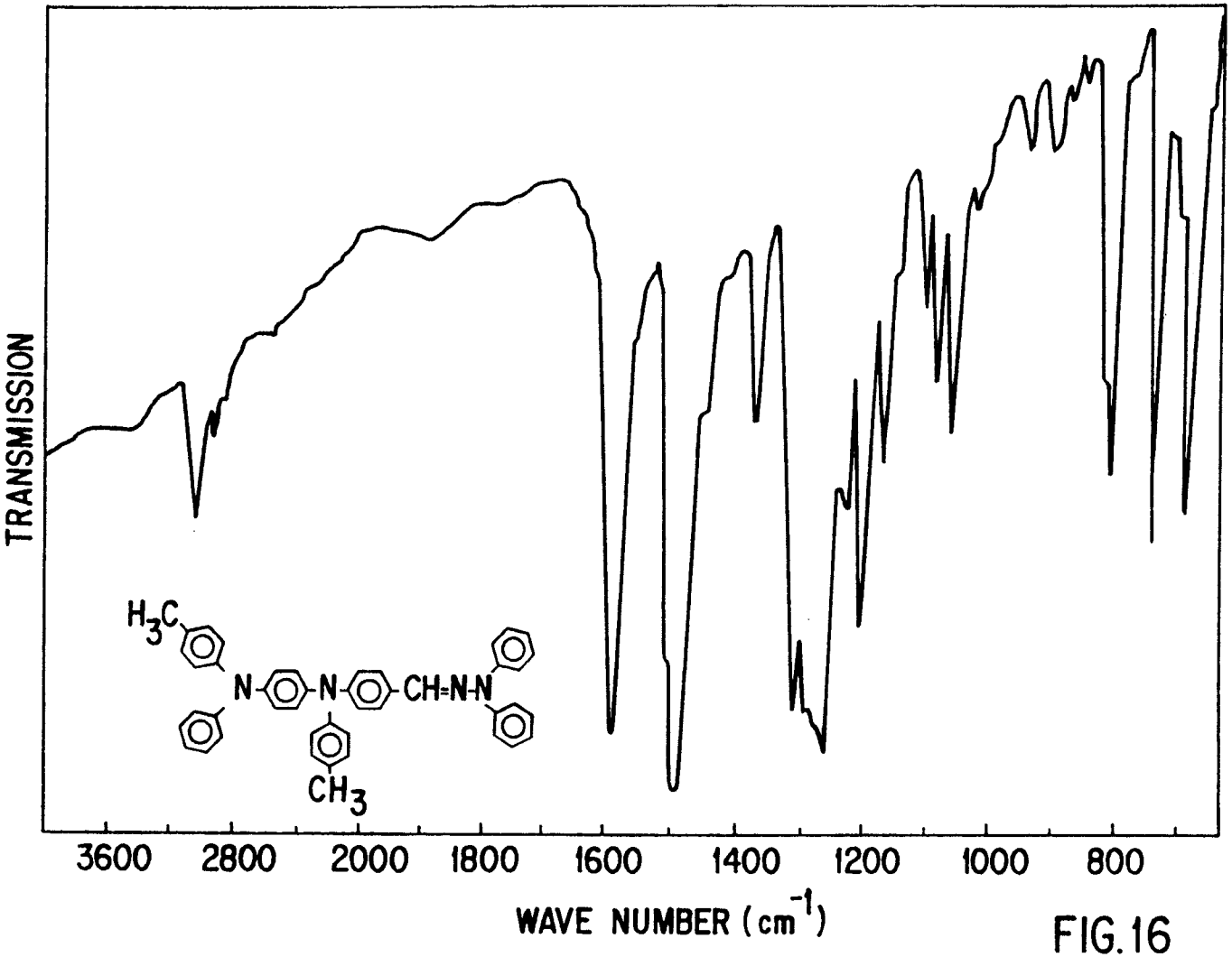
Figure 17:
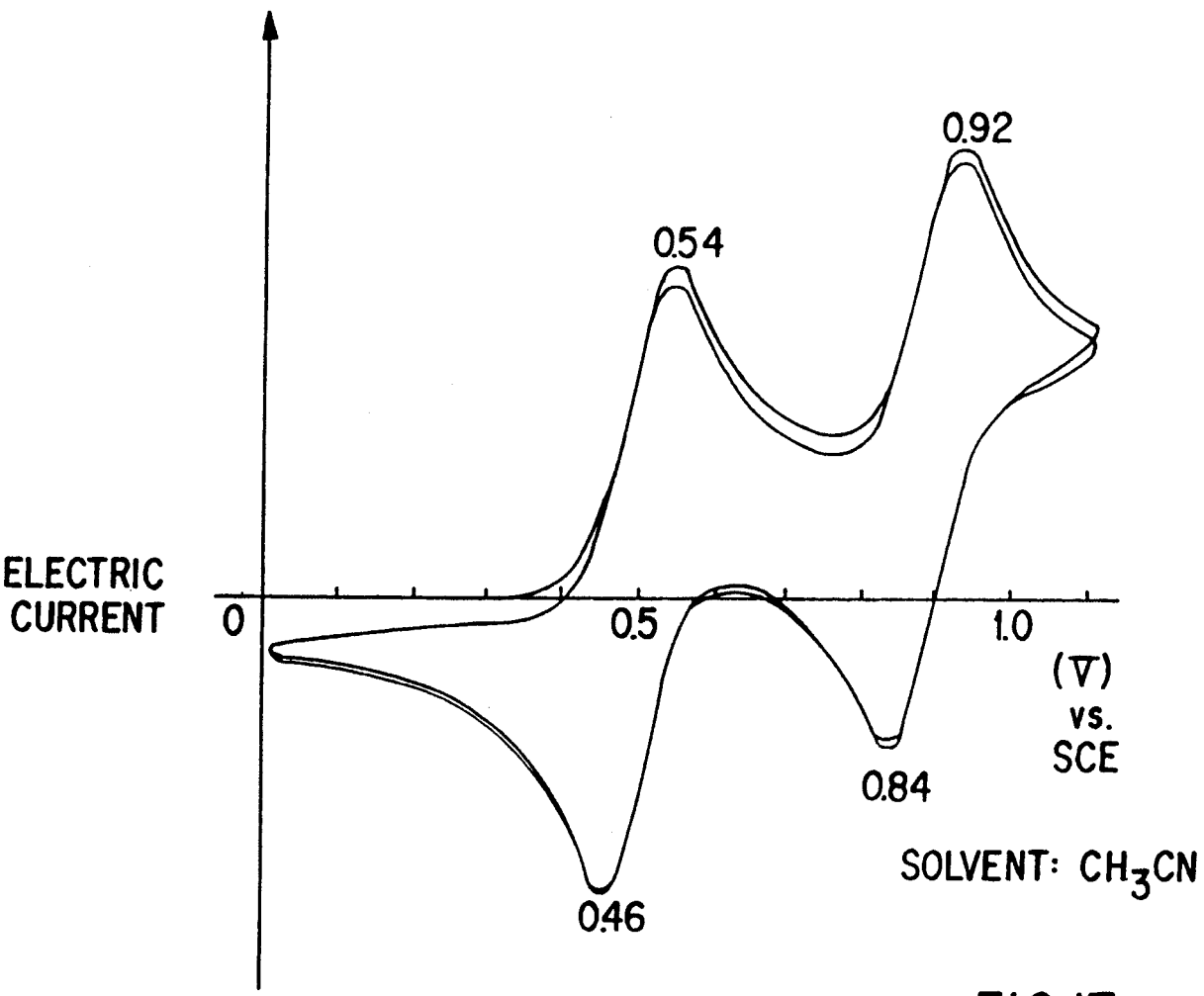

The infrared absorption spectrum of the compound is shown in FIG. 16, and the cyclic voltamogram in FIG. 17. It showed complete reversibility in an oxidation-reduction reaction.

REFERENCE EXAMPLE 9

Synthesis of p-[(p-(methylphenylamino)phenyl)methyl]aminobenzaldehydemethylphenylhydrazone—Compound (12)

An amount of 10 g (0.032 mol) of p-[(p-methylphenylamino)phenyl)methyl]aminobenzaldehyde and 7.79 g (0.064 mol) of methylphenylhydrazine were reacted at a reflux temperature for five hours in 200 ml of tetrahydrofuran in a flask having a nitrogen atmosphere.

After the completion of the reaction, the solvent was removed by distillation, whereby an oily matter was obtained. The oily matter was purified and separated by silica gel chromatography employing a mixed solvent of benzene and hexane (1/1), and then recrystallized twice from a mixed solvent of benzene and ethanol (1/1), to provide 7.3 g (yield: 48%) of the compound as fine, pale yellow crystals.

Melting point: 152°-154° C.

Mass Analysis: Molecular ion peak 420 Elemental Analysis:

| Elemental Analysis: | C | H | N |
|---|---|---|---|
| Calculated | 79.97 | 6.71 | 13.32 |
| Observed | 80.22 | 6.64 | 13.23 |

Figure 18:
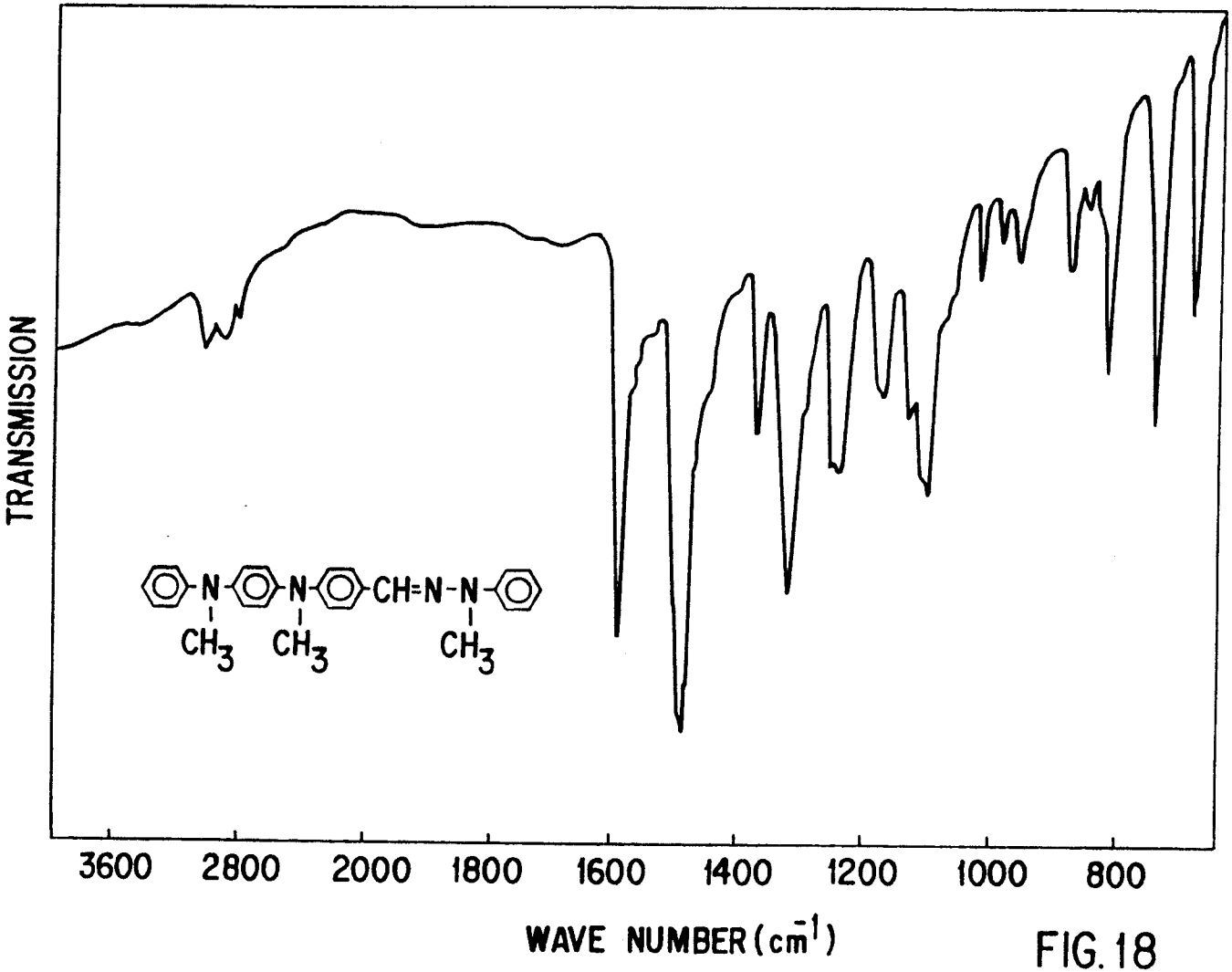
Figure 19:
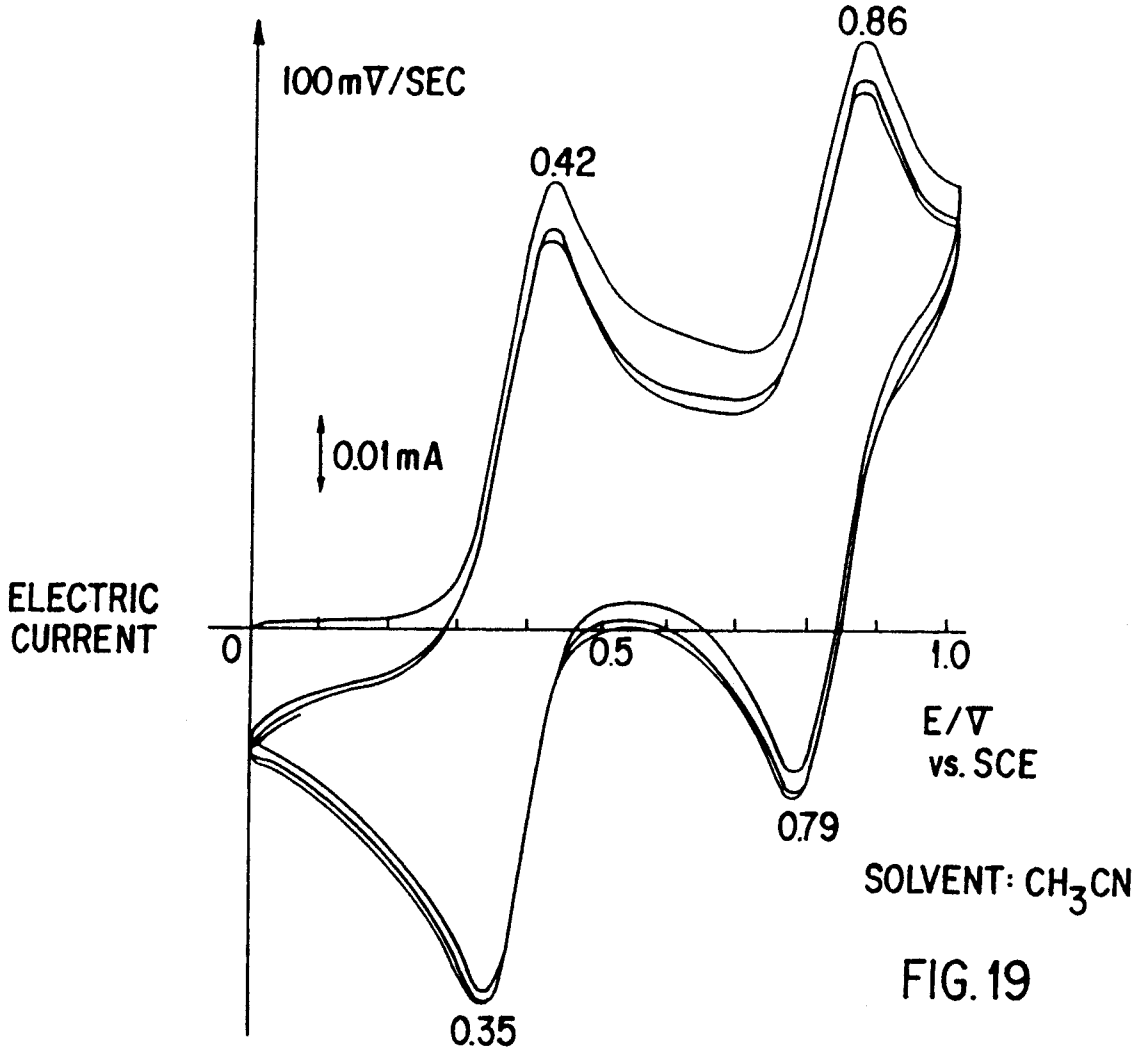

The infrared absorption spectrum of the compound is shown in FIG. 18, and the cyclic voltamogram in FIG. 19. It showed complete reversibility in an oxidation-reduction reaction. A compatibilized composition was prepared by dissolving the compound in polycarbonate in equal proportions by weight and its charge transfer rate is shown in Table 1.

TABLE 1

| Charge Transporting Substance | Charge Transfer Rate $\mu$ ($cm^2/V \cdot sec$) |
|---|---|
| Compound (1) | $2.76 \times 10^{-6}$ |
| (2) | $2.76 \times 10^{-6}$ |
| (3) | $2.73 \times 10^{-6}$ |
| (4) | $1.76 \times 10^{-6}$ |
| (5) | $1.40 \times 10^{-6}$ |
| (6) | $1.40 \times 10^{-6}$ |
| (7) | $2.01 \times 10^{-6}$ |
| (8) | $2.11 \times 10^{-6}$ |
| (12) | $1.26 \times 10^{-6}$ |
| Comparative compound | $1.10 \times 10^{-6}$ |

Notes:
(a) Measured at an electric field of $10^5$ V/cm and a temperature of 25° C.
(b) Comparative compound: N,N-diethylaminobenzaldehydediphenylhydrazone

EXAMPLE 1

A mixture of 2.2 parts by weight of X-type nonmetal phthalocyanine (8120B from Dainippon Ink Kagaku Kogyo K. K.) of which X-ray difraction pattern is shown in FIG. 1, 1.6 parts by weight of ethylene/vinyl acetate/vinyl chloride copolymer (Graftmer R-5 from Nippon Zeon K. K.) and 96.2 parts by weight of tetrahydrofuran was milled in a ball mill for two hours to prepare a dispersion. The dispersion was applied by a doctor blade onto an aluminum film deposited on a polyethylene terephthalate film, allowed to dry at room temperature and then dried by heating at 100° C. for 60 minutes, to form a charge producing layer having a thickness of 0.6 microns.

Six parts by weight of polycarbonate (Yupiron E-2000 from Mitsubishi Gas Kagaku Kogyo K. K.) and 6 parts by weight of p-[(p-diphenylaminophenyl)phenyl-]aminobenzaldehydemethylphenylhydrazone [Compound (1)] were dissolved in 88 parts by weight of chloroform to prepare a solution. The solution was applied onto the charge producing layer by a doctor blade having a clearance of 100 microns, allowed to dry at room temperature and then dried by heating at 80° C. for 60 minutes to form a charge transporting layer having a thickness of 1.5 microns, whereby a laminated photosensitive material was obtained.

EXAMPLES 2-6

Laminated photosensitive materials were prepared in the same manner as in the Example 1 using hydrazone compounds shown in Table 2 as a charge transporting substance.

COMPARATIVE EXAMPLE 1

A laminated photosensitive material was prepared in the same manner as in the Example 1 using a hydrazone compound (a) as a charge transporting substance as represented by the formula:

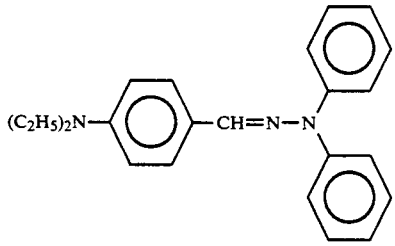

COMPARATIVE EXAMPLE 2

A laminated photosensitive material was prepared in the same manner as in the Example 1 using a hydrazone compound (b) as a charge transporting substance as represented by the formula:

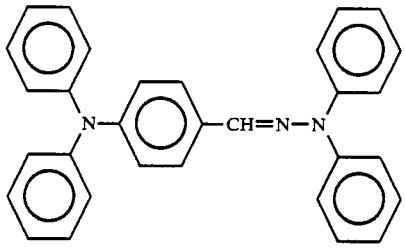

COMPARATIVE EXAMPLE 3

A laminated photosensitive material was prepared in the same manner as in the Example 1 using a hydrazone compound (c) as a charge transporting substance as represented by the formula:

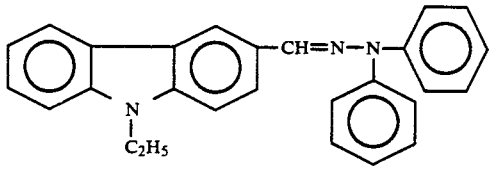

COMPARATIVE EXAMPLE 4

A laminated photosensitive material was prepared in the same manner as in the Example 1 using a hydrazone compound (d) as a charge transporting substance as represented by the formula:

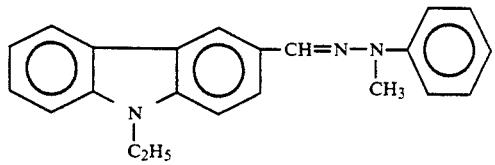

COMPARATIVE EXAMPLE 5

A mixture of 0.17 parts by weight of polycarbonate (Yupiron E-2000 from Mitsubishi Gas Kagaku Kogyo K. K.), 0.33 parts by weight of titanyl phthalocyanine as a charge producing substance and 99.5 parts by weight of chloroform was milled in a ball mill for 20 hours to prepare a dispersion. The dispersion was applied by a doctor blade having a clearance of 50 microns onto an aluminum film deposited on a polyethylene terephthalate film, allowed to dry at room temperature and then dried by heating at 80° C. for 60 minutes, to form a charge producing layer having a thickness of 0.3 microns.

A charge transporting layer was then formed on the charge producing layer in the same manner as in the Example 1, whereby a laminated photosensitive material was obtained.

COMPARATIVE EXAMPLE 6

A laminated photosensitive material was prepared using p-[(p-(phenyl-p-tolylamino)phenyl)-p-tolyl-]aminobenzaldehydemethylphenylhydrazone [Compound (2)] as a charge transporting substance in the same manner as in the Comparative Example 5.

COMPARATIVE EXAMPLE 7

A laminated photosensitive material was prepared using p-[(p-(phenyl-p-chlorophenyl)phenyl)-p-chlorophenyl]aminobenzaldehydediphenylhydrazone [Compound (3)] as a charge transporting substance in the same manner as in the Comparative Example 5.

COMPARATIVE EXAMPLE 8

A laminated photosensitive material was prepared using p-[(p-(phenyl-p-chlorophenyl)phenyl)-p-chlorophenyl]aminobenzaldehydemethylphenylhydrazone [Compound (4)] as a charge transporting substance in the same manner as in the Comparative Example 5.

COMPARATIVE EXAMPLE 9

A laminated photosensitive material was prepared using p-[(p-diphenylaminophenyl)phenyl]aminobenzaldehydemethyl-p-chlorophenylhydrazone [Compound (5)] as a charge transporting substance in the same manner as in the Comparative Example 5.

COMPARATIVE EXAMPLE 10

A laminated photosensitive material was prepared using p-[(p-methylphenylamino)phenyl)methyl-]aminobenzaldehydediphenylhydrazone [Compound (6)] as a charge transporting substance in the same manner as in the Comparative Example 5.

The laminated photosensitive materials prepared as above set forth were each evaluated for electrostatic charging characteristics by use of an electrostatic charging testing device (Model EPA 8100 from Kawaguchi Denki Seisakusho).

The surface of photosensitive material was negatively charged with a charge corona of −6 KV, and the surface potential was measured as an initial potential. Then, after the photosensitive material was left standing in the dark over a period of five seconds, the surface was irradiated with monochromatic light having a wavelength of 750 nm and a luminous intensity of 0.5 $\mu W/cm^2$. The length of time was measured until the point at which the surface potential dropped to a half of its initial value, and the half-time exposure $E_{\frac{1}{2}}$ ($\mu J/cm^2$) of the photosensitive material to that point of time was determined as its photosensitivity.

Further, the surface potential after five seconds from the irradiation of light was measured as a residual potential. The results are shown in Table 2.

TABLE 2

| | Charge Transporting Substance | Charge Producing Substance*) | Initial Potential (V) | Half-time Exposure $E_{\frac{1}{2}}$ ($\mu J/cm^2$) | Residual Potential (V) |
|---|---|---|---|---|---|
| Example 1 | Compound (1) | X | 1146 | 0.56 | 14 |
| 2 | (2) | X | 1044 | 0.51 | 2 |
| 3 | (3) | X | 1035 | 0.42 | 4 |
| 4 | (3) | X | 750 | 0.50 | 9 |
| 5 | (5) | X | 1089 | 0.51 | 9 |
| 6 | (6) | X | 943 | 0.58 | 15 |
| Comparative 1 | Compound (a) | X | 1294 | 0.97 | 128 |
| 2 | (b) | X | 1076 | 0.51 | 43 |
| 3 | (c) | X | 1050 | 0.52 | 59 |
| 4 | (d) | X | 1221 | 0.58 | 51 |
| Comparative 5 | Compound (1) | T | 774 | 0.45 | 1 |
| 6 | (2) | T | 382 | 0.44 | 48 |
| 7 | (3) | T | 854 | 0.52 | 7 |
| 8 | (4) | T | 568 | 0.35 | 59 |
| 9 | (5) | T | 664 | 0.53 | 5 |
| 10 | (6) | T | 687 | 0.63 | 18 |

*) X: X-type nonmetal phthalocyamine; T: titanyl phthalocyanine

What is claimed is:

1. A laminated organic photosensitive material which comprises an electroconductive support, a charge producing layer and a charge transporting layer formed thereon wherein the charge producing layer contains X-type nonmetal phthalocyanine as a charge producing substance and the charge transporting layer contains an arylaldehydehydrazone derivative of the general formula:

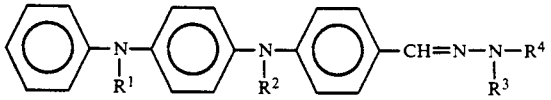

wherein $R^1$, $R^2$, $R^3$ and $R^4$ are each an alkyl or an aryl group.

2. The laminated organic photosensitive material as claimed in claim 1 wherein $R^1$, $R^2$, $R^3$ and $R^4$ are each methyl, ethyl, propyl, butyl, phenyl, tolyl or chlorophenyl.

3. The laminated organic photosensitive material as claimed in claim 1 wherein the arylaldehydehydrazone derivative is p-[(p-diphenylaminophenyl)phenyl-]aminobenzaldehydemethylphenylhydrazone.

4. The laminated organic photosensitive material as claimed in claim 1 wherein the arylaldehydehydrazone derivative is p-[(p-phenyl-p-tolylamino)phenyl)-p-tolyl-]aminobenzaldehydemethylphenylhydrazone.

5. The laminated organic photosensitive material as claimed in claim 1 wherein the arylaldehydehydrazone derivative is p-[(p-phenyl-p-chlorophenyl)phenyl)-p-chlorophenyl]aminobenzaldehydediphenylhydrazone.

6. The laminated organic photosensitive material as claimed in claim 1 wherein the arylaldehydehydrazone derivative is p-[(p-phenyl-p-chlorophenyl)phenyl)-p-chlorophenyl]aminobenzaldehydemethylphenylhydrazone.

7. The laminated organic photosensitive material as claimed in claim 1 wherein the arylaldehydehydrazone derivative is p-[(p-diphenylaminophenyl)phenyl-]aminobenzaldehydemethyl-p-chlorophenylhydrazone.

8. The laminated organic photosensitive material as claimed in claim 1 wherein the arylaldehydehydrazone derivative is p-[(p-methylphenylamino)phenyl)methyl-]aminobenzaldehydediphenylhydrazone.

9. The laminated organic photosensitive material as claimed in claim 1 wherein the arylaldehydehydrazone derivative is p-[(p-diphenylaminophenyl)phenyl-]aminobenzaldehydediphenylhydrazone.

10. The laminated organic photosensitive material as claimed in claim 1 wherein the arylaldehydehydrazone derivative is p-[(p-phenyl-p-tolylamino)phenyl)-p-tolyl-]aminobenzaldehydediphenylhydrazone.

11. The laminated organic photosensitive material as claimed in claim 1 wherein the arylaldehydehydrazone derivative is p-[(p-phenyl-m-tolylamino)phenyl)-m-tolyl]aminobenzaldehydediphenylhydrazone.

12. The laminated organic photosensitive material as claimed in claim 1 wherein the arylaldehydehydrazone derivative is p-[(p-phenyl-m-tolylamino)phenyl)-m-tolyl]aminobenzaldehydemethylphenylhydrazone.

13. The laminated organic photosensitive material as claimed in claim 1 wherein the arylaldehydehydrazone derivative is p-[(p-phenylethylaminophenyl)ethyl-]aminobenzaldehydediphenylhydrazone.

14. The laminated organic photosensitive material as claimed in claim 1 wherein the arylaldehydehydrazone derivative is p-[(p-methylphenylamino)phenyl)methyl-]aminobenzaldehydemethylphenylhydrazone.

* * * * *